US005658679A

United States Patent [19]

Shiratori

[11] Patent Number: 5,658,679

[45] Date of Patent: Aug. 19, 1997

[54] PERSONAL ORNAMENTS

[75] Inventor: Masami Shiratori, Kurobe, Japan

[73] Assignee: YKK Corporation, Tokyo, Japan

[21] Appl. No.: 502,744

[22] Filed: Jul. 14, 1995

[30] Foreign Application Priority Data

Jul. 18, 1994 [JP] Japan ..... 6-186838

[51] Int. Cl.[6] ..... B32B 15/08

[52] U.S. Cl. ..... 428/623; 428/626; 428/632; 428/658

[58] Field of Search ..... 428/623, 626, 428/632, 658, 674

[56] References Cited

U.S. PATENT DOCUMENTS

| | | | |
|---|---|---|---|
| 4,172,702 | 10/1979 | Bernier et al. | 427/27 |
| 4,238,250 | 12/1980 | Kasahara et al. | 148/6.1 |
| 4,297,405 | 10/1981 | Kasahara et al. | 428/328 |
| 4,314,859 | 2/1982 | Kasahara et al. | 148/6.1 |
| 4,610,929 | 9/1986 | Mosser et al. | 428/421 |
| 4,917,779 | 4/1990 | Katsuma | 204/37.1 |
| 4,917,967 | 4/1990 | Cupolo et al. | 428/669 |
| 5,022,938 | 6/1991 | Wieczerniak | 148/267 |

FOREIGN PATENT DOCUMENTS

| | | |
|---|---|---|
| 0 200 007 | 11/1986 | European Pat. Off. . |
| 0 417 880 | 3/1991 | European Pat. Off. . |
| 0635865 | 1/1995 | European Pat. Off. . |
| 4-74567 | 3/1992 | Japan . |
| WO82/02991 | 9/1982 | WIPO . |

OTHER PUBLICATIONS

Patent Abstract of Japan, vol. 13, No. 169 (C-587), Apr. 21, 1989 & JP-A-63 317696 (Nippon Steel) Dec. 26, 1988.

Database WPI, Section Ch, Week 8315, Derwent Publications Ltd., London, GB; Class A32, AN 83 36000k & JP A-58 039 448 (Toyo Kohan KK), Mar. 8, 1983.

Patent Abstracts of Japan, vol. 950, No. 003, & JP-A-07 057631 (Sony Corp.) Mar. 3, 1995.

Patent Abstracts of Japan, vol. 002, No. 150 (E-078), 15 Dec. 1978 & JP-A-53 118363 (Sony Corp.) Oct. 16, 1978.

*Primary Examiner*—John Zimmerman

*Attorney, Agent, or Firm*—Hill, Steadman & Simpson

[57] ABSTRACT

A personal ornament which has an appearance of nickel tone or black nickel 'tone' and assumes no magnetism is disclosed. In one embodiment of the personal ornament, a chromate layer is formed on a surface of a substrate made of pure zinc and a clear coating layer of brown color is superposed thereon. In another embodiment of the personal ornament, a Cu layer, a pure Zn layer, a chromate layer, and a clear coating layer of brown color are sequentially superposed in the order mentioned on a surface of a substrate made substantially of zinc. Further, in a personal ornament having an appearance of black nickel tone, a Cu layer, a Zn—Cu alloy layer, a brass activator conversion coating (blackly dyed) layer, and a clear coating layer of brown to black color are sequentially superposed in the order mentioned on a surface of a substrate made substantially of zinc.

19 Claims, 1 Drawing Sheet

PERSONAL ORNAMENTS

BACKGROUND OF THE INVENTION

1. Field of the Invention

This invention relates to personal ornaments or fancy goods, and more particularly to such fastening parts as a slider, a clamper, a pull tab, a top and a bottom stop, a divider, and elements in a slide fastener and such personal ornaments as buttons, buckles, belts, pendants, and accessories including necktie pins, hatpins, bracelets, earrings, watch chains, etc. which have appearances of nickel tone or black nickel tone.

2. Description of the Prior Art

Generally, the personal ornaments like fastening parts, buttons, buckles, belts, pendants, and accessories produce a weighty sensation of silver color when they have appearances of nickel tone. Thus, the nickel tone is popularly adopted for these ornamental items on account of the ability thereof to impart sensation of high quality to the appearances of the items.

Japanese Patent Application, KOKAI (Early Publication) No. 4-74567, for example, discloses a personal ornament which has a background part and a pattern part severally formed of metallic coating layers of different colors. In the embodiment of the personal ornament cited in the specification of this application, the background part as a basis comprises a nickel plated layer and, therefore, has the appearance of nickel tone.

When the surface layer of a personal ornament is formed of nickel, it indeed assumes an appearance of nickel tone. If this personal ornament is such as to touch the user's skin directly or indirectly, however, it will entail the problem of possibly causing the user to contract metal allergy (nickel allergy).

When this nickel layer is formed by the electroplating technique, it assumes magnetism. Particularly, the fastening parts which use this nickel layer, therefore, possibly pose a problem in the needle detecting work. Specifically, when the fastening parts are sewn to textile articles, these textile articles are probed to determine whether or not the segments of broken needles remain therein. Since the nickel layers in the fastening parts are mistakenly detected by the needle detector because of their magnetism, the needle detector fails to operate accurately and reliably.

SUMMARY OF THE INVENTION

An object of the present invention, therefore, is to provide a personal ornament which has an appearance of nickel tone or black nickel tone procucing the sensation of high quality, avoids causing the user to contract metal allergy, and assumes no magnetism and consequently allows the needle detector to operate accurately and reliably in examining textile articles having fastening parts sewn thereto in search of segments of broken needles.

To accomplish the object mentioned above, in accordance with the first aspect of the present invention, there is provided a personal ornament characterized by having a chromate conversion coating layer or chromate layer formed on the surface of a substrate made of pure zinc and a clear coating layer of brown color superposed thereon.

According to the second aspect of the present invention, there is provided a personal ornament characterized by having a copper layer, a pure zinc layer, a chromate layer, and a clear coating layer of brown color sequentially superposed in the order mentioned on the surface of a substrate made substantially of zinc.

According to the third aspect of the present invention, there is provided a personal ornament characterized by having a copper layer, a Zn—Cu alloy layer, a brass activator conversion coating layer (hereinafter referred to briefly as "BA layer") or blackly dyed layer, and a clear coating layer of brown to black color sequentially superposed in the order mentioned on the surface of a substrate made substantially of zinc.

Preferably, the colored clear coating layer mentioned above is formed of a transparent resinous coating material, preferably a two-pack reaction type epoxy-urethane resin coating material, containing in a ratio of not more than 20% by weight of a brown or black coloring agent such as, for example, a brown dye or a brown to black pigment or dye.

BRIEF DESCRIPTION OF THE DRAWINGS

Other objects, features, and advantages of the invention will become apparent from the following description taken together with the drawings, in which.

DESCRIPTION OF THE PREFERRED EMBODIMENTS

The present inventor continued a diligent study in search of a method of surface treatment capable of imparting to a personal ornament an appearance of nickel tone producing the sensation of high quality without recourse to nickel plating. As a result of this study, he has acquired a knowledge that an appearance of nickel tone can be produced by chromating the surface of a substrate or base material made of pure zinc or a pure zinc layer formed on a substrate and subsequently coating the chromated surface with a clear coating layer of brown color.

Specifically, according to the first and the second embodiment of the present invention mentioned above, the combination of the chromate treatment or chromate filming performed on a base made of pure zinc with the clear coating layer of brown color realizes the appearance of nickel tone and the presence of the colored clear coating layer in the outermost layer stabilizes the color of the nickel tone and, at the same time, protects the product against magnetization.

The present inventor, as a result of his further study, has acquired a knowledge that an appearance of black nickel tone, unlike the color tone obtained in the first and the second embodiment mentioned above, is produced by performing a brass activator treatment (hereinafter referred to briefly as "BA treatment") or black dyeing treatment on a base made of a Zn—Cu alloy and subsequently forming on the treated surface a clear coating layer of brown to black color.

Now, the stratal constructions of the personal ornaments according to the embodiments of the present invention and the processes of treatments involved for their production will be described below with reference to the accompanying drawings.

Figure 1:
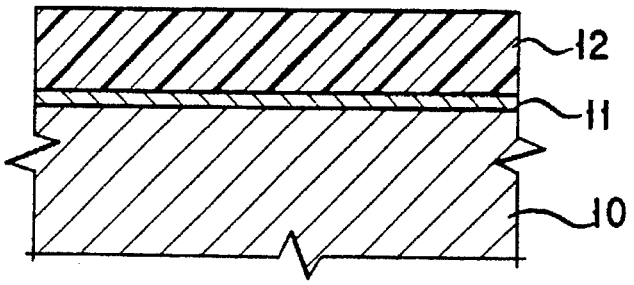
FIG. 1 is an enlarged, fragmentary cross-sectional schematic view showing the stratal construction of the personal ornament of the first embodiment of the present invention.

FIG. 1 shows the stratal construction of a personal ornament of the first embodiment of the present invention. In FIG. 1, the reference numeral 10 stands for a substrate formed of pure zinc, 11 for a chromate conversion coating layer or chromate layer superposed thereon, and 12 for a clear coating layer of brown color constituting itself the outermost layer.

When the substrate to be used is made of pure zinc, it should first undergo a chromate treatment in order for the final product to acquire an appearance of nickel tone. The chromate layer 11 is necessary for the purpose of improving the corrosion resistance of the product and the adhesiveness of the colored clear coating layer and, at the same time, imparting to the product the color of nickel tone. For the chromate layer 11 to manifest the expected effect, it is desired to have a thickness of not more than 2 μm, preferably not more than 1 μm.

Then, the clear coating layer 12 of brown color is formed on the chromate layer 11. This colored clear coating layer 12 serves to impart the appearance of nickel tone to the product and, at the same time, stabilize the color tone in conjunction with the chromate layer 11, and protect the product against magnetization and consequently prevent the user of the product from contracting nickel (metal) allergy. For the colored clear coating layer to manifest the expected effect to advantage, it is desired to have a thickness in the range of from 3 to 10 μm, preferably from 5 to 10 μm.

The substrate is desired to be made of pure zinc with purity of not less than 99.99%.

The aforementioned clear coating layer 12 of brown color can be formed by mixing a transparent resinous coating material as a main component with a brown oil-soluble dye, diluting the resultant mixture with a thinner to a degree of viscosity suitable for a particular coating method to be adopted, and applying the diluted coating material to the chromate layer 11 by a suitable technique such as, for example, the barrel coating, electrostatic coating, electrodeposition coating, or the like. The barrel coating process is proved to be particularly suitable for coating a small personal ornament.

The main component of the colored clear coating layer 12 is desired to possess low-temperature drying characteristics and excel in abrasion resistance and dry-cleaning resistance. Thus, transparent resinous coating materials excepting water-soluble coating materials (including emulsion coating materials) and polyester resin coating materials are usable for the main component. Particularly, two-pack reaction type epoxy-urethane resin coating materials are used advantageously.

The dye to be incorporated in the transparent resinous coating material is desired to excel in coloring power, produce a clear tint, and offer high resistance to light and chemicals. Any of the brown oil-soluble dyes which satisfy such requirements can be used. Light Brown 3406U and Brown 3407T (both manufactured by Orient Kagaku K.K.) are concrete examples. If the amount of the dye to be added to the transparent resinous coating material exceeds 20%, the adhesiveness of the coating layer will be unduly low. Thus, the total amount of the dye to be added to the transparent resinous coating material is desired to be not more than 20% by weight. When the aforementioned Light Brown 3406U and Brown 3407T are jointly used, for example, it suffices to add 5.3 to 15.9% by weight of Light Brown 3406U and 1.1 to 3.3% by weight of Brown 3407T.

A typical procedure which advantageously implements the formation of the colored clear coating layer mentioned above by the rotary barrel spray coating, namely a process which coats a given substrate with a coating material by setting the substrate in a rotatably installed barrel and then keeping the substrate in rotation and meanwhile spraying the coating material onto the substrate by the use of a spray gun disposed opposite the mouth of the barrel, will be described below. First, the substrate is air-conditioned by blowing air against the substrate for a period of from 90 to 120 seconds. Then, the coating material is sprayed onto the substrate by an automatic spray gun operated under the conditions of 2.6 to 4.0 kg/cm$^2$ of atomizing air pressure, 10 to 40 cc/minute of discharge rate, 60 to 150 seconds of coating time, and 20 to 40 r.p.m. of barrel rotating speed. Subsequently, the wet layer of the coating material is set (predried) with hot air of 90° C. for a period of from 180 to 240 seconds, further dried with hot air of 140° C. for a period of from 12 to 16 minutes, and cooled with cold air for a period of from 270 to 360 seconds. After such a cycle of air conditioning, coating, setting (predrying), drying, and cooling is repeated four or five times, the coated product is extracted from the barrel. The personal ornament of the first embodiment of the present invention is obtained as a finished product as described above.

Figure 2:
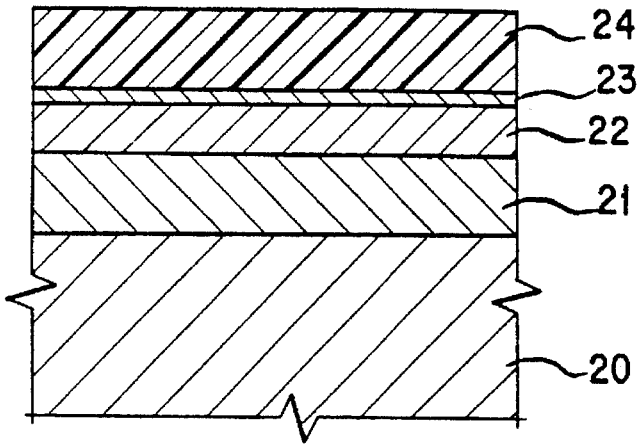
FIG. 2 is an enlarged, fragmentary cross-sectional schematic view showing the stratal construction of the personal ornament of the second embodiment of the present invention.

FIG. 2 shows the stratal construction of a personal ornament of the second embodiment of the present invention. In FIG. 2, the numeral 20 stands for a substrate made of diecast zinc, 21 for a Cu layer, 22 for a pure Zn layer, 23 for a chromate layer, and 24 for a clear coating layer of brown color superposed thereon.

In the case of a substrate which is a diecast product as in a fastening part, a zinc alloy containing about 4% of aluminum for the purpose of improving mechanical properties and flow property of molten metal is used. If the substrate of diecast zinc is directly plated with a pure Zn layer, the problem will ensue that aluminum which is contained in the diecast zinc diffuses in the pure Zn layer and darkens it. Further, there exists the problem that the diecast product has a heavy surface roughness. The present invention, therefore, proposes to coat the substrate 20 first with the Cu layer 21 exhibiting high adhesiveness to diecast zinc of which the substrate 20 is formed and then with the pure Zn layer 22 intended to impart metallic luster thereto. Thereafter, the chromate layer 23 and the colored clear coating layer 24 are sequentially superposed thereon in the same manner as in the first embodiment mentioned above.

The Cu layer 21 mentioned above is desired to have a thickness in the range of from 5 to 20 μm for the purpose of preventing aluminum contained in the diecast zinc from diffusing into the pure Zn layer and enabling the formed film to acquire a flat surface. The pure Zn layer 22 to be formed an the Cu layer 21 is desired to have purity of not less than 99.99% and to have a thickness in the range of from 3 to 15 μm for the purpose of preventing the Cu layer from being exposed by the chromate etching (chromate treatment) and, at the same time, enabling the formed film to acquire a flat surface. The chromate layer 23 and the clear coating layer 24 of brown color which are sequentially superposed on the pure Zn layer 22 mentioned above have the same purposes and thicknesses as the equivalent layers used in the first embodiment mentioned above.

The metal layers mentioned above can be formed by various means such as, for example, electroplating, ion plating, vacuum deposition, and electroless plating. From the viewpoint of continuity of productional operation, a barrel plating process combined with the barrel coating process mentioned above proves to be host desirable.

A typical procedure which advantageously implements this barrel plating process will be described below. First, the surface of the substrate of diecast zinc is subjected to the pretreatments of degreasing, washing with water, neutralizing, and washing with water as popularly practiced. Then, the substrate with a cleaned surface is subjected to a copper strike in a bath containing sodium cyanide and cuprous cyanide as main components and then to a copper plating in a bath similarly containing sodium cyanide and cuprous cyanide as main components. Thereafter, the plated substrate is washed with water and subjected to a zinc plating in a bath containing sodium cyanide, zinc cyanide, and caustic soda. In this case, it is desirable to use zinc of purity of not less than 99.99% as the material for the zinc plating electrode plate. The zinc-plated substrate is washed again with water, then activated for several second in a treating liquid containing 2 to 10 ml of 67.5% nitric acid per liter, and subsequently washed with water, subjected to a chromate treatment, washed with water, washed with hot water, and dried. Thereafter, the dried substrate is subjected to the same barrel coating as described above with respect to the first embodiment.

Figure 3:
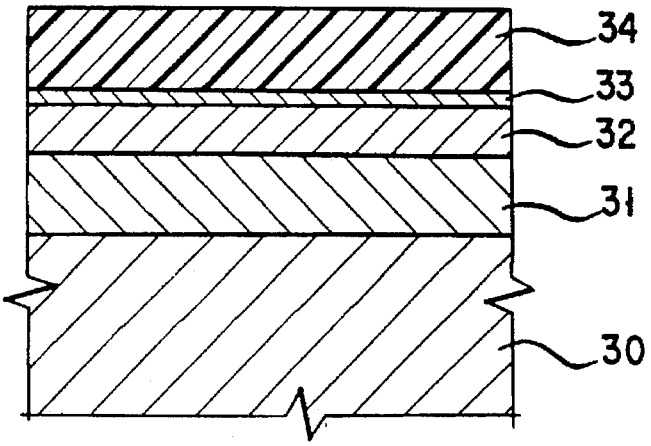
FIG. 3 is an enlarged, fragmentary cross-sectional schematic view showing the stratal construction of the personal ornament of the third embodiment of the present invention.

FIG. 3 shows the stratal construction of a personal ornament of the third embodiment of the present invention. In FIG. 3, the numeral 30 stands for a substrate (diecast zinc), 31 for a Cu layer, 32 for a Zn—Cu alloy layer, 33 for a BA (blackly dyed) layer, and 34 for a clear coating layer of brown to black color superposed sequentially thereon.

In the personal ornament of this third embodiment of the present invention, the surface of the substrate 30 which is made of diecast zinc is coated with the Cu layer 31 for the purpose of preventing impurities contained therein from diffusing and enabling the formed film to acquire a flat surface. This Cu layer 31 is desired to have a thickness in the range of from 5 to 20 μm for the same reason as in the second embodiment mentioned above. Then, the Cu—Zn alloy layer 32 is superposed on the Cu layer 31 mentioned above for the impartation of metallic luster. This Cu—Zn alloy layer 32 is desirably made of brass. It is desired to have a thickness in the range of from 3 to 15 μm for the purpose of preventing the Cu layer from being exposed by the subsequent BA (black dyeing) treatment and, at the same time, enabling the formed film to acquire a flat surface. Thereafter, the superposed layers consequently obtained are immersed in a high-concentration aqueous caustic soda solution kept at high temperature to effect the BA (black dyeing) treatment. The BA (blackly dyed) layer 33 is necessary for the purpose of improving the corrosion resistance of the product and the adhesiveness of the colored clear coating layer and, at the same time, producing an appearance of black nickel tone. The BA layer 33 is desired to have a thickness of not more than 2 μm to produce such effects. Then, the BA (blackly dyed) layer 33 is coated with the clear coating layer 34 of brown to black color. The purpose, thickness, and coating method of this colored clear coating layer 34 are similar to those of the first and the second embodiment mentioned above. In the case of the personal ornament of the third embodiment, a coating material obtained by compounding such a brown to black pigment as Raven® 1255 (black) or iron oxide red (brown) (both manufactured by Colombian Chemicals, Co.) or such a dye as Black 3820 or Blue 2606 (both manufactured by Orient Kagaku K.K.) with a transparent resinous coating material, preferably a two-pack reaction type epoxy-urethane resin coating material, is used for obtaining an appearance of black nickel tone. This coating material may contain a small amount of metal powder, preferably aluminum powder, to produce a metallic luster. The amounts of such coloring agents as dye and pigment to be incorporated in the transparent resinous coating material are desired to be such that their total may account for a proportion of not more than 20% by weight in consideration of the adhesiveness of the coating film as remarked above.

It is clearly remarked from the description given above that the personal ornaments of the second and the third embodiment do not always need to use a substrate of diecast zinc. Any substrate consisting substantially of zinc and containing impurities may be used instead.

Now, the present invention will be described more specifically below with reference to working examples.

EXAMPLE 1

Substrates of pure zinc (purity: 99.99%) were degreased, neutralized, and washed with water as popularly practiced, then immersed in a treating liquid containing chromic anhydride, a sulfate, and nitric acid at a total concentration in the range of from 7 to 12 ml/liter and having a pH in the range of from 1.6 to 1.8 to effect a chromate treatment therein for 15 to 17 seconds, and subsequently subjected to a barrel coating consisting of four to five cycles each of the aforementioned air conditioning, coating, setting (predrying), drying, and cooling steps and using a coating material obtained by mixing a two-pack reaction type epoxy-urethane resin coating material with dyes [No. 0-8872 (light brown) and No. 0-8860 (mahogany) manufactured by Mikuni Paint K.K.] and diluting the resultant mixture with a thinner. The products consequently obtained invariably had a stratal structure shown in FIG. 1 and an appearance of nickel tone. They assumed no magnetism.

EXAMPLE 2

Fastening parts (sliders, clampers, pull tabs, top and bottom stops, and elements) made by the die casting of zinc were degreased, neutralized, and washed with water as popularly practiced, subjected to a copper strike in a bath containing 48 g of sodium cyanide, 30 g of cuprous cyanide, and 20 g of sodium bicarbonate each per liter and having a temperature of 30°±5° C. and a pH of 10.5±0.5 at 18 to 20 V (100 to 150 A) for 5½ minutes, then to a copper plating in a bath containing 81 g of sodium cyanide, 60 g of cuprous cyanide, 30 g of potassium sodium tartrate ($KNaC_4H_4O_6$), and 3 cc of brightener each per liter and having a temperature of 50°±5° C. and a pH of 12.5±0.5 at 9 to 11 V (110 to 160 A) for 88 minutes, washed with water, and subsequently subjected to a zinc plating using a zinc electrode plate of purity of 99.99% in a bath containing 16 g of sodium cyanide, 18 g of zinc cyanide, and 60 g of caustic soda each per liter and having a temperature of not less than 30° C. and a pH of less than 13 at 13 to 15 V (170 to 190 A) for 76 minutes, then washed with water, activated by 2 to 3 seconds' immersion in an aqueous solution containing 2 to 10 ml of 67.5% nitric acid per liter, washed with water, chromated by 15 to 17 seconds' immersion in a treating liquid containing chromic anhydride, a sulfate, and nitric acid in a total concentration of 7 to 12 ml/liter and having a pH of 1.6 to 1.8 (manufactured by Nippon Hyomen-Kagaku K.K. and marketed under trademark designation of "Jasco MU-365"), washed with water, washed with hot water (demineralized water), and dried by centrifugation. The treated fastening parts thus obtained were subjected to a barrel coating using the same coating material as used in Example 1 and performed in the same manner as in Example 1. The products consequently obtained invariably had a stratal construction shown in FIG. 2 and an appearance of nickel tone. They assumed no magnetism.

EXAMPLE 3

Fastening parts made by the die casting of zinc were degreased, neutralized, and washed with water as popularly practiced and then subjected to a copper strike and a copper plating treatment in the same manner as in Example 2. Then, the treated fastening parts were subjected to a brass plating with an electrode plate of seven-three brass (content of Zn: 30%) in a bath containing 60±5 g of sodium cyanide, 30±5 g of cuprous cyanide, and 8.5±1.5 g of zinc cyanide each per liter and having a temperature of 38° C. and a pH of 9.5 at 130 to 140 A for about 100 minutes, washed with water, washed with acid, and then subjected to a BA (black dyeing) treatment in an aqueous 95% caustic soda solution at 90° C. for 4 to 8 minutes. Thereafter, the treated fastening parts were washed with water, washed with hot water (demineralized water), dried by centrifugation, and subjected to a barrel coating using a coating material obtained by mixing a two-pack reaction type epoxy-urethane resin coating material with pigments [No. 0-8510 (black, Ravene® 1255) and No. 0-8572 (brown, iron oxide red) sold by Mikuni Paint K.K.], dyes [No. 0-8810 (black) and No. 0-8840 (blue) manufactured by Mikuni Paint K.K.], and aluminum powder (Sap 5501N® manufactured by Showa Aluminum K.K.) and diluting the resultant mixture with thinner and following the procedure of Example 1. The products thus obtained invariably had a stratal construction shown in FIG. 3 and an appearance of black nickel tone. They assumed no magnetism. When red brass (content of Zn: 15%) was used in the place of the seven-three brass mentioned above, the BA (black dyeing) treatment proceeded more easily because of a higher copper content.

The present invention provides personal ornaments which have an appearance of nickel tone or black nickel tone and emit a sensation of high quality as demonstrated above. The appearance of nickel tone or black nickel tone which is assumed by the personal ornaments of the present invention is not produced by electrolytic nickel plating, but by a stratal construction resulting from the combination of a substrate formed of pure zinc with a chromate layer and a clear coating layer of brown color formed on the surface of the substrate or by a stratal construction resulting from the combination of a substrate formed substantially of zinc with a Cu layer, a pure Zn layer or a Zn—Cu alloy layer, a chromate layer or a BA (blackly dyed) layer, and a colored clear coating layer formed on the surface of the substrate. Thus, the personal ornaments assume no magnetism and have not a metal nickel layer but a resin coating layer as the outermost layer. Even when the personal ornaments of the present invention directly or indirectly touch the users' skin, therefore, they do not cause the users to contract metal (nickel) allergy. When the fastening parts embodying the present invention are sewn to textile articles and the textile articles are probed in search of segments of broken needles, the search by means of a needle detector is attained accurately. Further, the personal ornaments of the present invention exhibit outstanding adhesiveness between the adjoining component layers thereof and excel in resistance to weather and to corrosion. Owing to the use of a two-pack reaction type epoxy-urethane resin coating material as a transparent resinous coating material for the colored clear coating layer, the personal ornaments which are obtained according to the present invention excel in abrasion resistance and dry-cleaning resistance. Particularly, in the case of products which are intended as fastening parts, the sliders offer only small resistance to slide and permit smooth opening and closing motion and the fastener tapes to which the sliders are mounted enjoy a decrease in abrasion. These effects can be likewise expected in buttons, buckles, and belts which embody the present invention.

While certain embodiments and specific working examples have been disclosed herein, the invention may be embodied in other specific forms without departing from the spirit or essential characteristics thereof. The described embodiments and examples are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. A personal ornament, comprising a substrate made substantially of zinc and a Cu layer, a pure Zn layer, a chromate layer, and a clear coating layer of brown color sequentially superposed on a surface of said substrate in the order mentioned.

2. The personal ornament according to claim 1, wherein said colored clear coating layer is formed of a transparent resinous coating material containing a brown coloring agent in a proportion of not more than 20% by weight.

3. The personal ornament according to claim 2, wherein said transparent resinous coating material is a two-pack epoxy-urethane resin coating material.

4. The personal ornament according to claim 1, wherein said colored clear coating layer has a thickness in the range of from 3 to 10 μm.

5. The personal ornament according to claim 1, wherein said chromate layer has a thickness of not more than 2 μm.

6. The personal ornament according to claim 1, wherein said pure Zn layer has a thickness of not less than 3 μm.

7. The personal ornament according to claim 1, wherein said Cu layer has a thickness of not less than 5 μm.

8. The personal ornament according to claim 1, wherein said pure Zn layer is made of pure zinc with purity of not less than 99.99%.

9. The personal ornament according to claim 1, wherein said substrate is made of diecast zinc alloy.

10. The personal ornament according to claim 9, wherein said personal ornament is a fastening part.

11. A personal ornament, comprising a substrate made substantially of zinc and a Cu layer, a Zn—Cu alloy layer, a brass activator conversion coating layer, and a clear coating layer of brown to black color sequentially superposed on a surface of said substrate in the order mentioned.

12. The personal ornament according to claim 11, wherein said colored clear coating layer is formed of a transparent resinous coating material containing a brown or a black coloring agent in a proportion of not more than 20% by weight.

13. The personal ornament according to claim 12, wherein said transparent resinous coating material is a two-pack epoxy-urethane resin coating material.

14. The personal ornament according to claim 11, wherein said colored clear coating layer has a thickness in the range of from 3 to 10 μm.

15. The personal ornament according to claim 11, wherein said brass activator conversion coating layer has a thickness of not more than 2 μm.

16. The personal ornament according to claim 11, wherein said Zn—Cu alloy layer has a thickness of not less than 3 μm.

17. The personal ornament according to claim 11, wherein said Cu layer has a thickness of not less than 5 μm.

18. The personal ornament according to claim 11, wherein said substrate is made of diecast zinc alloy.

19. The personal ornament according to claim 18, wherein said personal ornament is a fastening part.

* * * * *